US007318362B1

(12) United States Patent
Hoyer et al.

(10) Patent No.: US 7,318,362 B1
(45) Date of Patent: Jan. 15, 2008

(54) COMBINED FUNCTION WINE BOTTLE FOIL CUTTER AND CORK REMOVER

(76) Inventors: Richard Hoyer, Avenida 74 No. 94-220, Maracaibo (VE); Francisca Werner, Avenida 74 No. 94-220, Maracaibo (VE)

( * ) Notice: Subject to any disclaimer, the term of this patent is extended or adjusted under 35 U.S.C. 154(b) by 0 days.

(21) Appl. No.: 11/623,945

(22) Filed: Jan. 17, 2007

(51) Int. Cl.
*B67B 7/04* (2006.01)
*B25F 1/00* (2006.01)

(52) U.S. Cl. ..... 81/3.45; 81/3.09; 7/155

(58) Field of Classification Search ..... 81/3.45, 81/3.09, 3.29; 7/155, 156
See application file for complete search history.

(56) References Cited

U.S. PATENT DOCUMENTS 4,845,844 A 7/1989 Allen
D364,324 S * 11/1995 Entwistle ..... D8/42
D404,987 S * 2/1999 Larimer ..... D8/38
6,101,899 A 8/2000 Nikolic
6,196,086 B1 3/2001 Gort-Barten
6,978,696 B2 * 12/2005 Yu ..... 81/3.29
7,024,715 B2 4/2006 Hefti et al.
2002/0178867 A1 * 12/2002 Lun ..... 81/3.2

* cited by examiner

*Primary Examiner*—David B. Thomas
(74) *Attorney, Agent, or Firm*—Malin, Haley & DiMaggio, P.A.

(57) ABSTRACT

A combined function foil cutter and cork remover comprising a hollow main body member with a circular upper and circular lower open end. The main body member comprises a plurality of flexible fingers separated by longitudinal slots extending a desired distance upward from the lower open end. The interior surface of each finger comprises at least one individual elongated blade located a designated distance from the lower open end. There is a spiral corkscrew inserted longitudinally within the main body member. The corkscrew is rotatably secured with a handle located at the upper open end of the main body member. There is a collar slidably set around the main body member. When the collar is slid towards the lower open end, the collar compresses each of said fingers together to align said individual elongated blades into one continuous circular blade.

15 Claims, 7 Drawing Sheets

COMBINED FUNCTION WINE BOTTLE FOIL CUTTER AND CORK REMOVER

BACKGROUND OF THE INVENTION

1. Field of the Invention

The invention relates generally to wine bottle corkscrews and more generally to corkscrews which also cut the foil from the mouth of a wine bottle.

2. Description of Related Art

The wine industry is a profitable segment of the economy. There are many different types of wines and wine bottles. As a result, the number of devices related to the consumption of wine is significant. Numerous different devices for removing corks from the bottle are available. Several devices for cutting the foil seal are available. However, there are no devices which easily cut the foil and remove the cork in a simple, efficient and continuous motion. There have been several attempts. For example, U.S. Pat. No. 6,196,086 issued on Mar. 6, 2001 to Gort-Barten entitled FOIL CUTTER FOR A CORKSCREW teaches a foil cutter that is separable from a corkscrew, but snaps together. The foil cutter comprises a pair of cutting wheels each having a circular cutting edge. The foil cutter is operated by pressing push buttons inwardly into foil and then rotating the cutter at least 180 degrees relative to the bottle.

U.S. Pat. No. 7,024,715 issued on Apr. 11, 2006 to Heffi et al. entitled CORK SCREW PROVIDED WITH A CAP CUTTER WHICH CAN BE INSERTED IN THE HANDLE teaches a cap cutter that is integrated into a corkscrew. The cap cutter is U-shaped and has an elastic connector and two legs stiffened by means of transverse ribs. The cap cutter has three rolling cutting disks. The cap cutter can be inserted into the rotatable handle of the corkscrew, and must be rotated at least 120 degrees to cut the foil.

U.S. Pat. No. 6,101,899 issued on Aug. 15, 2000 to Nikolic entitled ELECTRIC CORKSCREW teaches a corkscrew and foil cutter in the same device. The device has a main portion and a handle. The foil cutter is located in the handle. The foil cutter comprises a rotary de-briding cutter having a pair of opposed resiliently mounted cutter blades.

U.S. Pat. No. 4,845,844 issued on Jul. 11, 1989 to Allen entitled FOIL CUTTER teaches a cutting device comprising first and second force application members having cutting surfaces or edges facing inwardly. The device is in a U-shape with two flanges being connected by a back portion. The device or bottle is rotated at least 90 degrees when cutting the foil. The device is to be used with the thumb pushing one flange and the other finger pushing the other flange to cause force downward upon the foil. The Allen patent also contemplates the cutter being incorporated into the side of a cork remover. Thus, the user removes the foil and then alters the position of the cork screw to remove the cork.

The wine industry still lacks a device which can easily cut the foil and remove the cork in one continuous motion in easy fashion and in one complete structure, and does not alter or change the position of the corkscrew itself during the process of the cork removal.

SUMMARY OF THE INVENTION

A combined function foil cutter and cork remover comprising a hollow main body member with a circular upper and circular lower open end. The lower open end of the main body member has a larger diameter than the upper open end of the main body member. The main body member comprises six flexible finger elements separated by longitudinal slots extending a desired distance upward from the lower open end. The interior surface of each finger element comprises at least one individual annular blade located a designated distance from the lower open end. There is at least one internal shoulder surface located a desired distance away from the lower open end and upward from each at least one internal annular blade. There is a spiral corkscrew inserted longitudinally within the main body member. The corkscrew is rotatably secured with a handle located at the upper open end of the main body member. There is a frustoconical collar slidably set around the main body member. When the collar is slid towards the lower open end, the collar compresses each of said finger elements together to align said individual elongated blades into one continuous circular blade.

An object of the combined foil cutter and cork remover is to provide a device which easily cuts the foil on a bottle mouth and removes the cork from a bottle mouth without altering or changing the shape or position of the device, and manual contact with the cork is not required in the removal process.

In accordance with these and other objects which will become apparent hereinafter, the instant invention will now be described with particular reference to the accompanying drawings.

DETAILED DESCRIPTION

Figure 1:
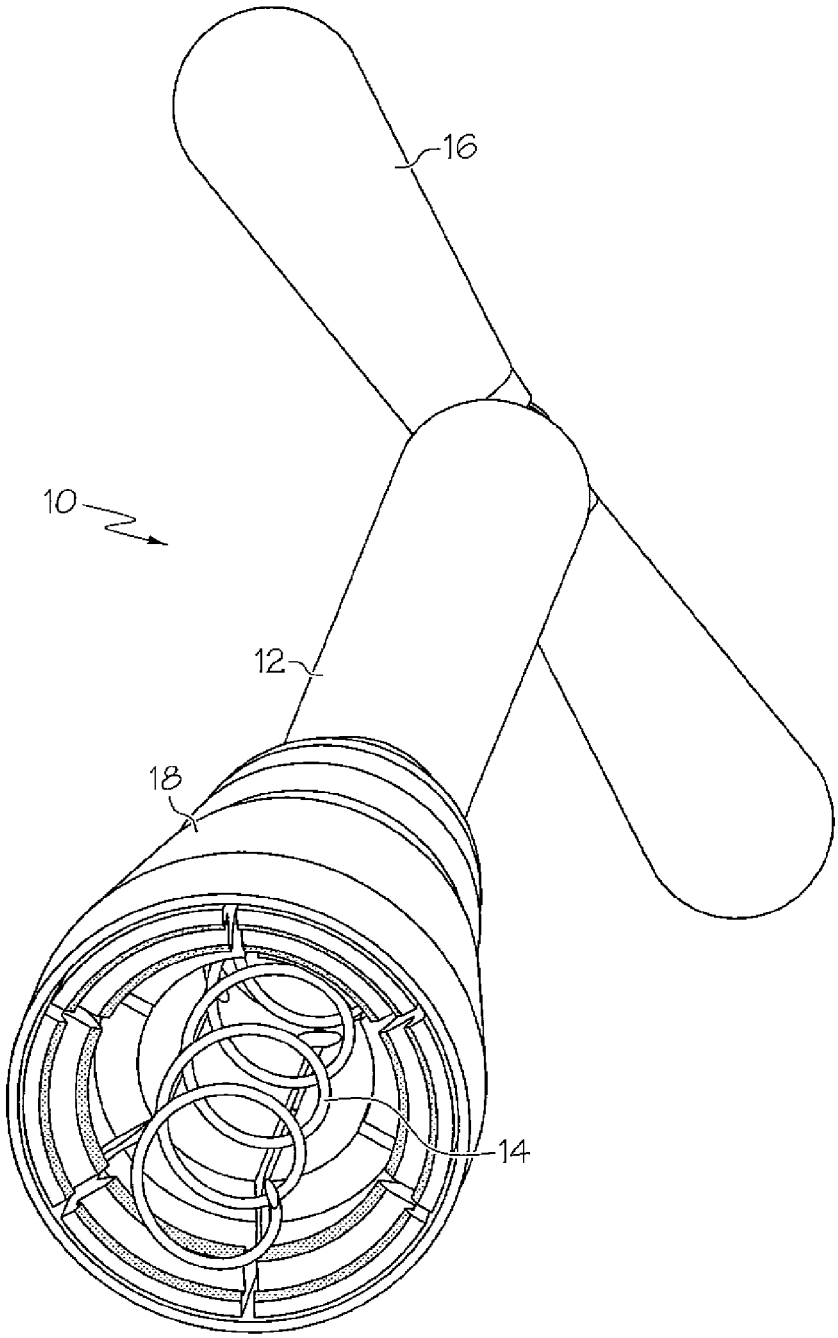
FIG. 1 shows a perspective view of the combined function foil cutter and cork remover.

With reference to FIG. 1, a perspective view of a combined function foil cutter and cork remover 10 is shown. It is contemplated that the combined function foil cutter and cork remover 10 will be used in conjunction with wine bottles and wine bottle corks. As shown, the combined function foil cutter and cork remover 10 generally comprises a main body member 12, a collar 18, a corkscrew 14 inserted within, and exiting out of the bottom of, the main body member 12, and a handle 16 secured at the top of the main body member 12.

Figure 2:
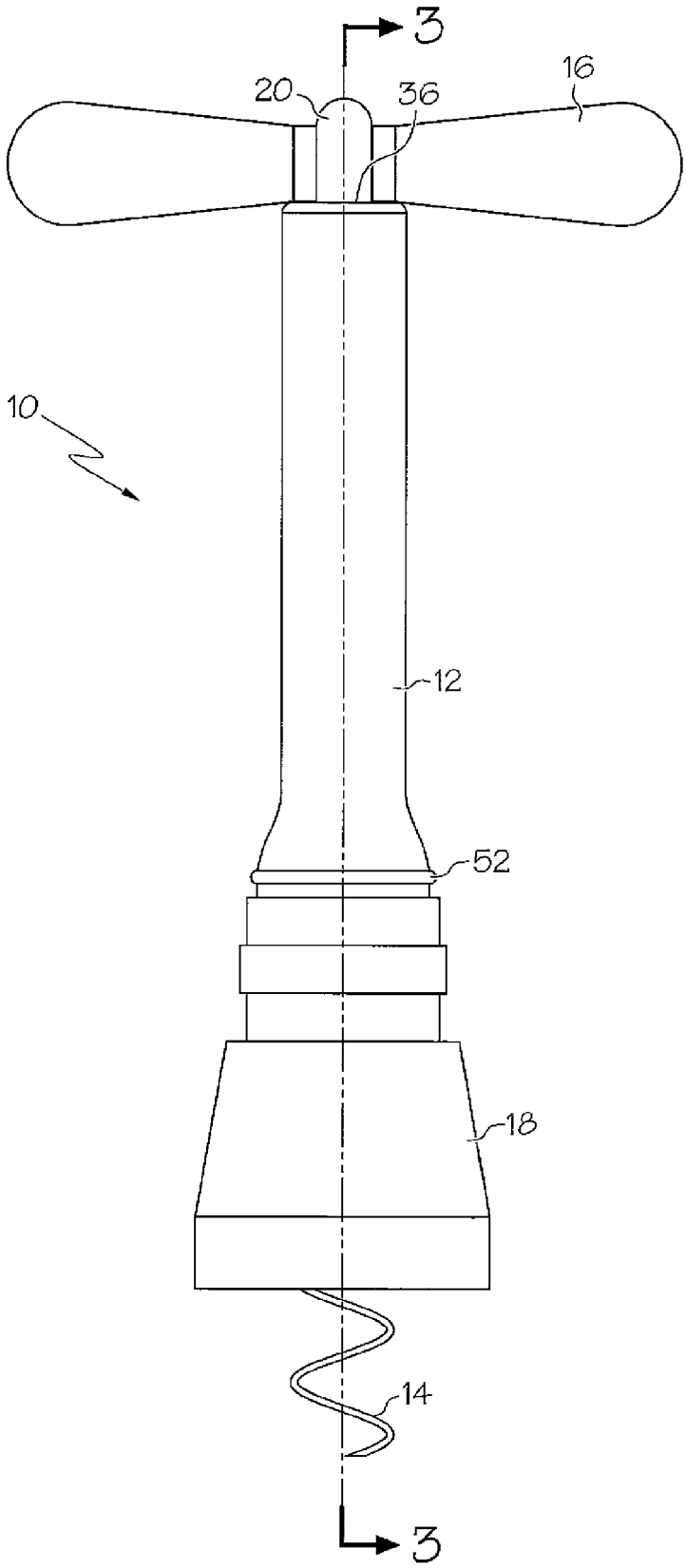
FIG. 2 shows a side plan view of the combined function foil cutter and cork remover.

With reference to FIG. 2, a side plan view of the combined function foil cutter and cork remover 10 is shown. As shown, a shaft 20 is inserted within the main body member 12 and exits out of the open top 36 of the main body member 12. The handle 16 secures to the shaft 20. The collar 18 is inserted over and around the lower portion of the main body member 12. The collar 18 has the form of a body of revolution with a cylindrical section and a frustoconical section. The collar 18 moves freely upwardly and downwardly along the outer surface of the main body member 12.

A retainer 52 is secured around the main body member 12 so as to contain the movement of the collar within operating limits along the main body member 12. As shown, the corkscrew 14 exits from the open bottom of the main body member 12 and the collar 18.

Figure 3A:
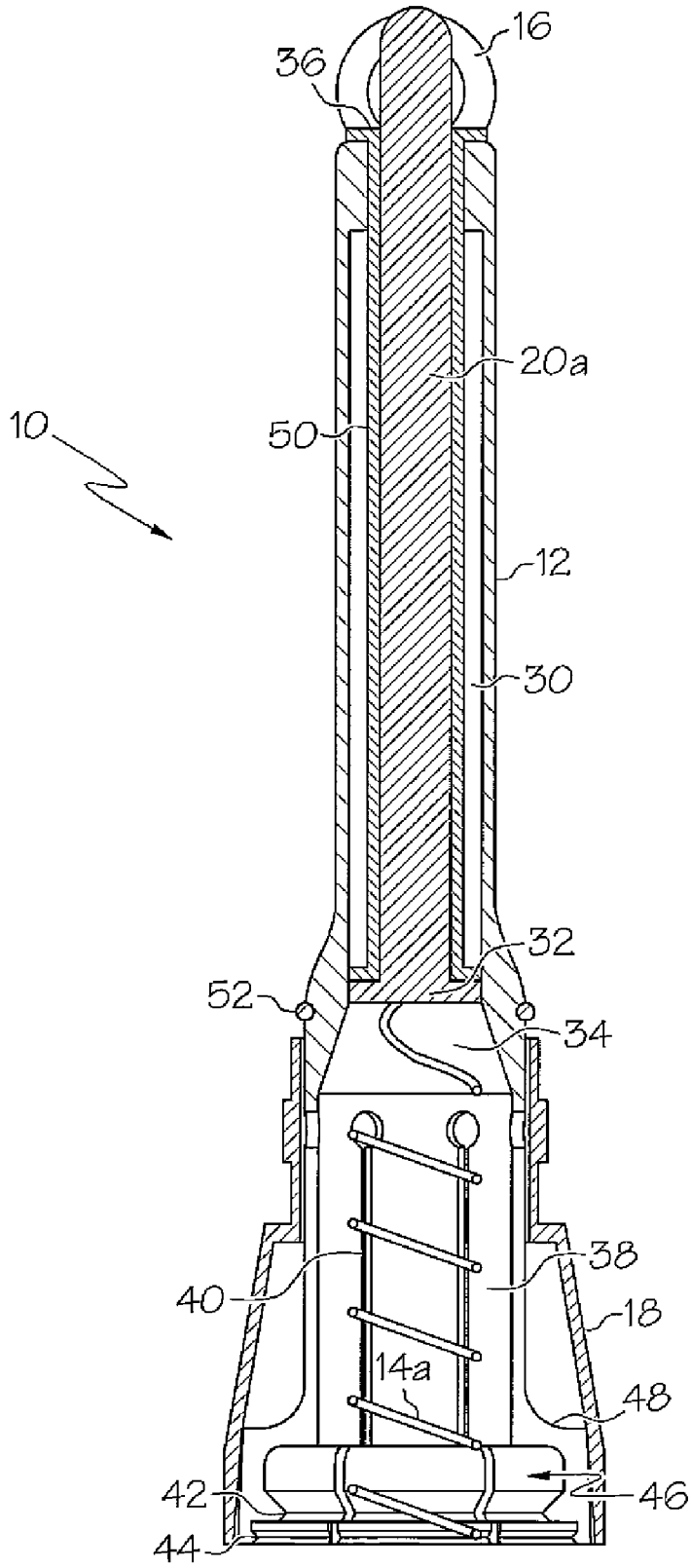
FIG. 3*a* shows a side cross sectional view of one embodiment of the combined function foil cutter and cork remover.

With reference to FIG. 3*a*, a cross sectional view of a first embodiment of the combined function foil cutter and cork remover 10 is shown. As shown, the main body member 12 has an upper section and a lower section. The lower section is wider and at the bottom, there is an opening. The lower section of the main body member 12 has a frustoconical section 34, a cylindrical chamber 38, and a wide opening 46 at the bottom. The entire main body member 12 is hollow. As shown, there are a plurality of blades 44, 42 found on the interior of the wide opening 46. The blades may be arranged so as to produce openings of different sizes. The blades 42 are contemplated to receive a regular size mouth of a wine bottle. The blades 44 are contemplated to receive a larger size mouth of a wine bottle. It is further contemplated that the blades 42, 44 will have an annular shape. As shown, there are a plurality of longitudinal slots 40 which extend from the wide opening 46, through the blades 42, 44, and upwardly a desired distance towards the upper section of the middle cylindrical chamber 38. These longitudinal slots 40 divide the lower portion into a plurality of flexible fingers which can be flexed inwardly, so as to align the separated blades 42, 44. When aligned, the blades will form a circle. It is contemplated that the preferred embodiment will utilize six longitudinal slots 40 each separated by sixty degrees to create six flexible fingers. Due to the elastic properties of the material of the main body member 12, the fingers can deflect or move radially to cut the foil seal of a wine bottle and also to restrain the cork from turning upon removal of the corkscrew 14*a*. In this first embodiment, the corkscrew 14*a* is fully contained within the cylindrical chamber 38.

As shown in FIG. 3*a*, the shaft 20*a* extends through the main body member 12. The shaft 20*a* exits through the open top 36 and attaches to the handle 16. The outer surface of the shaft 20*a* is contemplated to be threaded like a screw. The inner surface of the handle 16 which is placed over the shaft 20*a* is also contemplated to be threaded. It is contemplated that the upper end of the threaded shaft 20*a* will have a stop component that allows the handle to actuate the movable assembly as well as prevent disassembly of the removal components. At the base 32 of the shaft the corkscrew 14 is secured. During operation, it is contemplated that the cork will not come in contact with the base 32 of the shaft of the shaft 20*a*. It is contemplated that the shaft of the corkscrew 14 has a helicoidal right hand thread on its exterior surface. The shaft 20*a* is contemplated to be a cylindrical screw with a multiple lead left hand thread, which serves to transmit the necessary forces and movements required for cork removal. It is contemplated that the thread of the shaft 20*a* is of a lesser pitch than the corkscrew. It is contemplated that there may be a hollow cylindrical movable sleeve 50 contained within the main body member 12. The shaft 20*a* is inserted though the hollow center of the sleeve 50. The movable sleeve 50 has the geometrical form of a body of revolution. Each end of the sleeve 50 has a small flange to keep it aligned and contained within the upper chamber of the main body 12. The top flange would sit outside of the top open end of the main body member 12. The bottom flange would fit within the main body member 12. Thus, the sleeve 50 can move upward and downward within the main body member 12 to keep the shaft 20*a* aligned. The sleeve 50 serves as a movable guide for the necessary movement of the removal shaft and the precise positioning of the removal element for cork removal. When the handle 16*a* is turned clockwise with respect to the threaded shaft 20*a* it will move upwardly until contact is made with the incorporated stop on the upper end of the shaft. Continuous clockwise movement will then force the corkscrew 14 into the cork until the handle 16*a* comes in contact with the upper flange of the movable sleeve 50. As shown, the collar 18 fits over the lower portion of the main body member 12. The bottom opening of the collar 18 has a slightly larger diameter than the external bottom section of the main body member 46. The frustoconical shape of the collar 18 causes the top opening to be narrower. The top open end of the collar 18 is smaller than the bottom open end 46 of the main body member 12.

Figure 3B:
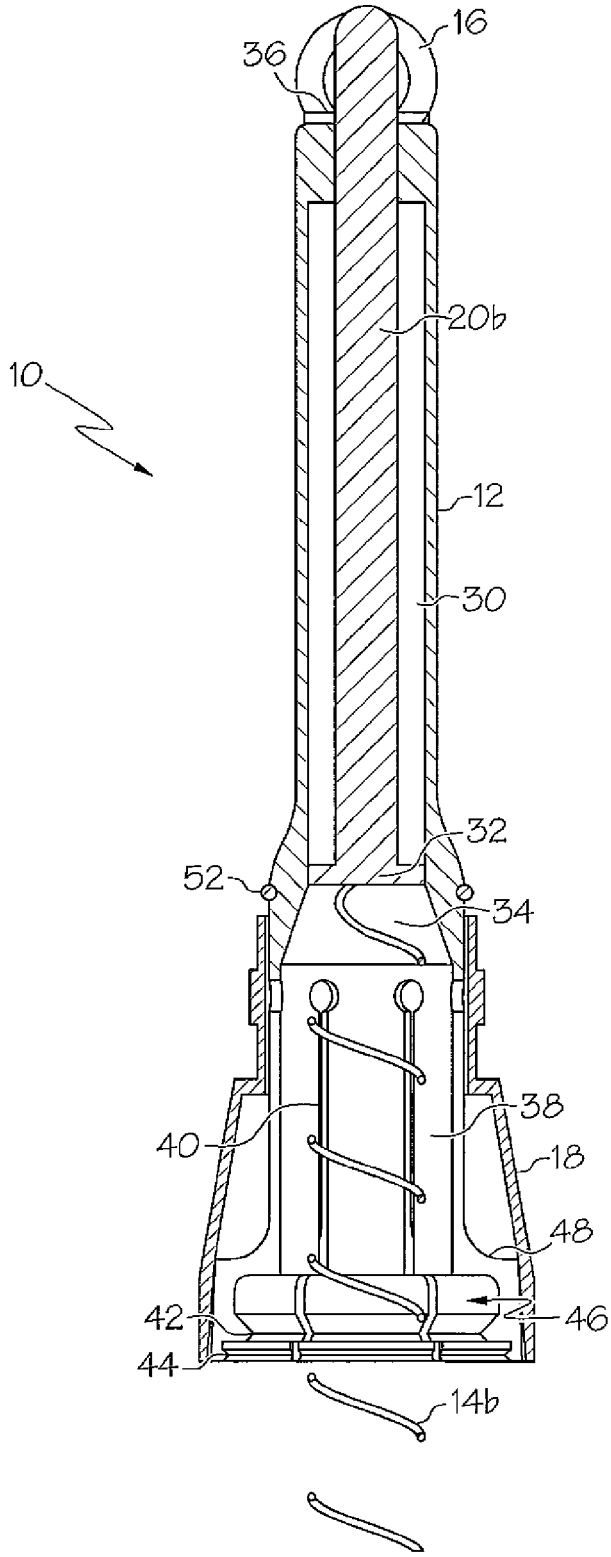
FIG. 3*b* shows a side cross sectional view of a second embodiment of the combined function foil cutter and cork remover.

With reference to FIG. 3*b*, a cross sectional view of a second embodiment of the combined function foil cutter and cork remover 10 is shown. As shown the shaft 20*b* in the second embodiment is not threaded and there is no sleeve 50 as found in the first embodiment. It is contemplated that the upper end of the threaded shaft 20*b* will be firmly secured to the handle 16*b* to actuate the movable assembly as well as prevent disassembly of the removal components. The second embodiment shown in FIG. 3*b* shows the corkscrew 14*b* to be longer than that of the first embodiment. The corkscrew 14*b* exits out of the cylindrical chamber 38. During operation, it is contemplated that the cork will not come in contact with the base 32 of the shaft of the shaft 20*b*.

Figure 4:
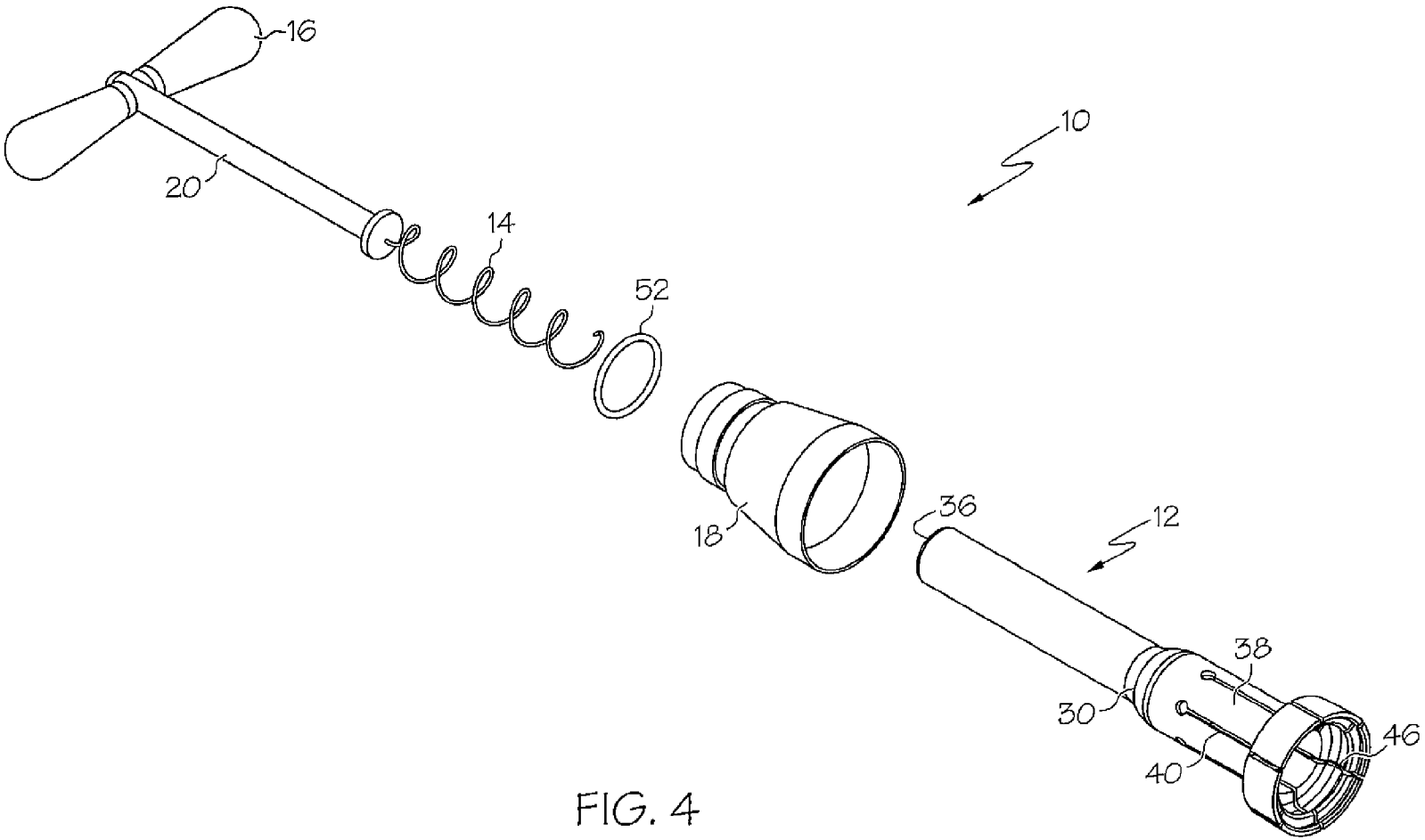
FIG. 4 shows an exploded perspective view of the combined function foil cutter and cork remover.

With reference to FIG. 4, an exploded perspective view of the combined function foil cutter and cork remover 10 is shown. As shown, the main body member 12 has a wider bottom opening 46 than the narrow top opening 36. The cylindrical hollow collar 18 slides over the main body member 12 and is stopped by the wide open bottom 46. The retainer 52 is inserted over the main body member 12 and prevents the collar 18 from moving upwardly along the main body member 12. The shaft 20 is inserted within the main body member 12 and exits out of the open top 36. The corkscrew 14 is secured to the base 32 of the shaft 20. As shown, the handle is secured to the top of the shaft 20.

Figure 5:
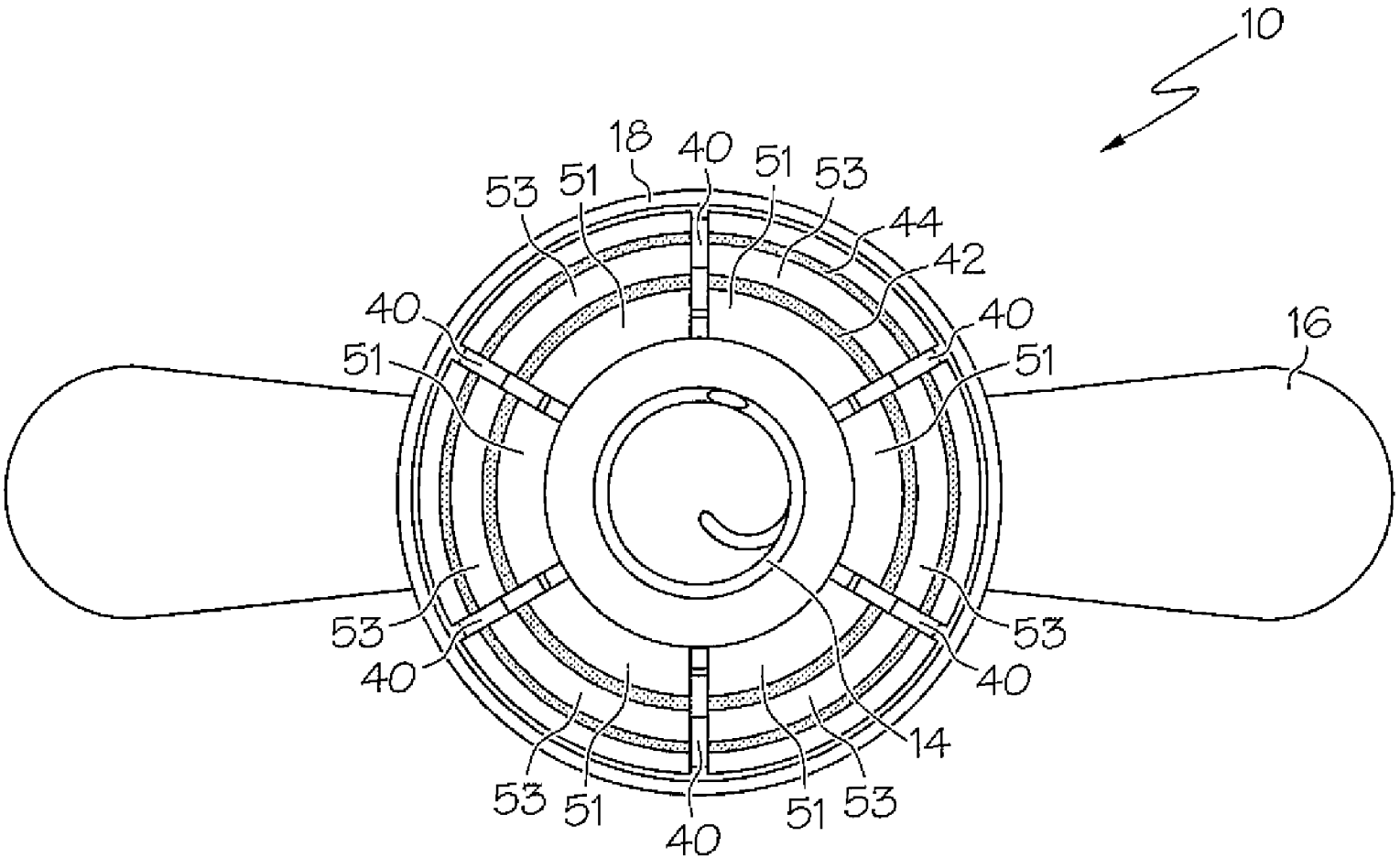
FIG. 5 shows a plan view of the combined function foil cutter and cork remover as taken from underneath the bottom opening.

With reference to FIG. 5, a plan view of the combined function foil cutter and cork remover 10 is shown as viewed from the bottom open end of the main body 46. As shown the corkscrew 14 is inserted within the main body member 12. The lower section of the main body member 12 is shown as having inner blades 42 and outer blades 44, all of which are separated by the longitudinal slots 40. There are inner shoulder structures 51 which will provide a stop when the mouth of a wine bottle is inserted. It is contemplated that a second set of outer shoulders 53 will provide a stop when a larger mouth of a larger wine bottle is inserted. It is contemplated that the shoulder structures 51, 53 will comprise sturdy flat surfaces which support the lower section of the main body member 12 while the blades 42, 44 are pressed inwards. As shown, the collar 18 is inserted over the flexible fingers of the main body member 12.

Figure 6:
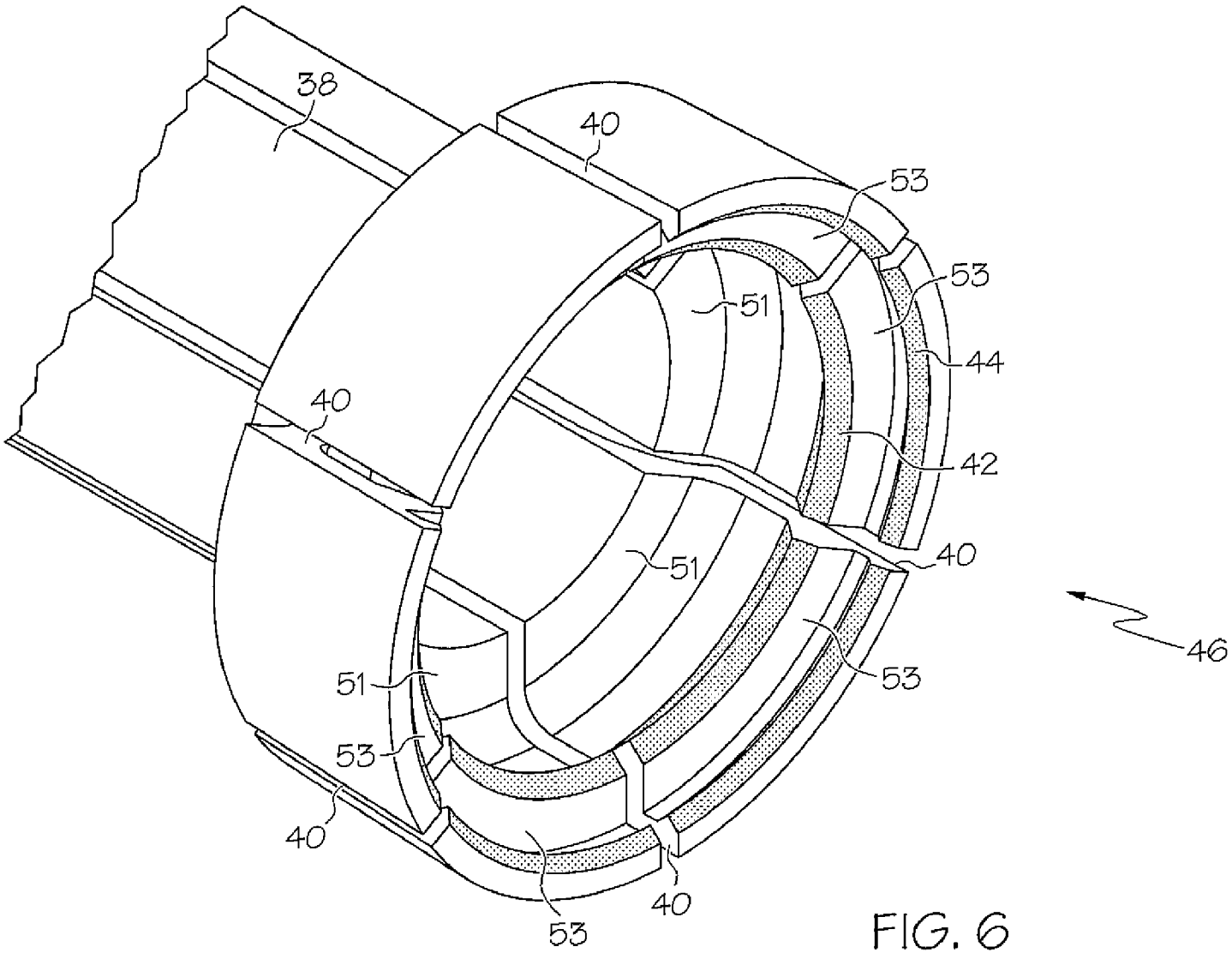
FIG. 6 shows an enlarged perspective view of the bottom opening of the combined function foil cutter and cork remover.

With reference to FIG. 6, an enlarged perspective view of the lower open end 46 of the main body member 12 is shown. The cylindrical chamber 38 in the lower main body is shown as being divided by longitudinal slots 40. As shown, the bottom portion 46 has a larger circumference than the cylindrical chamber 38. The bottom portion is divided by the same longitudinal slots 40 as the cylindrical chamber 38. As shown, the blades 42 have a smaller circumference than blades 44. The blades 42, 44 are separated by longitudinal slots 40. The inner blades 42 are mounted to a sturdy shoulder 53 that extends inwardly from the main body member. A second sturdy shoulder 51 with a smaller circumference is located above the blades 42 within the main body member 12. The purpose of the shoulders is to provide a surface on which to rest the top of the mouth of a wine bottle when the combined function foil cutter and cork remover 10 is in use.

The combined function foil cutter and cork remover 10 is operated as follows, reference is made for the embodiment shown in FIG. 3*a*. The open bottom end 46 of the combined function foil cutter and cork remover 10 is placed over the mouth of a wine bottle so that the blades 42, 44 are positioned around the circumference of the foil seal. Depending on the size of the wine bottle, either the outer 44 or inner 42 blades will be used. The mouth of a wine bottle is inserted and the particular shoulder provides a surface on which the combined function foil cutter and cork remover 10 rests. With a manual movement, the collar 18 is moved downwardly over the wider open end 46 of the main body member 12. The frustoconical shape of the collar 18 and the downward force causes the separated fingers and blades 42, 44 to be compressed inwardly into alignment. This alignment causes the blades 42, 44 to pierce the foil seal of a wine bottle. At this point, the user manually turns the collar slightly back and forth thus cutting the foil. Very little turning is required. The handle 16 is then turned with a clockwise movement causing the shaft 20 to move downward through the sleeve 50. This also turns the corkscrew 14 and pushes the corkscrew 14 downward through the top of the foil seal and into the cork in the wine bottle. The handle 16 is turned clockwise until the corkscrew 14 is completely inserted through the cork. The handle is then turned in the counter clockwise direction and the shaft 20 will begin to exit the main body member 12. Because of the lesser pitch, this also removes the cork from the wine bottle and pulls it into the lower section of the main body member 12. To remove the cork from the corkscrew 14, the handle is further rotated in the counter clockwise manner further until the cork comes in contact with the frustoconical section 34 of the lower chamber of the main body 12 to prevent the turning of the cork while the corkscrew 14 is being extracted. It is contemplated that the actions of removing the foil seal and removing the cork are integral and continuous processes. The combined function corkscrew remover 10 allows the user to remove the foil seat and the cork without touching either the foil seal or the cork and without altering the position of structure of the combined function corkscrew remover 10.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combined function wine bottle foil cutter and cork remover comprising:

a hollow main body member with an open top and an open bottom;

wherein the main body member comprises a plurality of flexible finger elements separated by longitudinal slots extending a desired distance upward from the open bottom;

wherein the lower interior surface of each finger comprises at least one blade located a designated distance from the open bottom;

a spiral corkscrew inserted longitudinally within the main body member;

wherein the corkscrew is rotatably secured with a shaft extending towards, and inserted into, a handle located at the open top of the main body member;

wherein the handle has an interior passageway into which the shaft is inserted; and a collar slidably set around the main body member;

wherein, when the collar is slid towards the open bottom, the collar compresses each of said finger elements together to align each of said blades into one continuous flexible annular blade.

2. The combined function wine bottle foil cutter and cork remover described in claim 1 wherein the main body member further comprises at least one internal shoulder surface located a desired distance upward from each at least one internal blade.

3. The combined function wine bottle foil cutter and cork remover described in claim 1 wherein the collar has an upper cylindrical section and a lower frustoconical section.

4. The combined function wine bottle foil cutter and cork remover described in claim 1 wherein the main body member comprises six identical flexible finger elements each separated by a longitudinal slot.

5. The combined function wine bottle foil cutter and cork remover described in claim 1 wherein, when the collar is pushed downward over the open bottom, it applies a compression force onto the open bottom of the main body member and aligns the flexible finger elements.

6. The combined function wine bottle foil cutter and cork remover described in claim 1, further comprising a hollow movable sleeve within the main body member into which the shaft is inserted.

7. The combined function wine bottle foil cutter and cork remover described in claim 6 wherein the exterior surface of the shaft has a threaded pattern and the interior passageway found in the handle comprises a threaded pattern complimentary to the threaded shaft.

8. A combined function wine bottle foil cutter and cork remover comprising:

a hollow main body member with an open top and an open bottom;

wherein the main body member comprises a plurality of flexible finger elements separated by longitudinal slots extending a desired distance upward from the open bottom;

wherein the interior surface of each finger comprises at least one individual blade located a designated distance from the open bottom;

a spiral corkscrew inserted longitudinally within the main body member;

wherein the corkscrew is rotatably secured with a shaft extending towards, and inserted into, a handle located at the open top of the main body member;

wherein the handle has an interior passageway into which the shaft is inserted; and a collar slidably set around the main body member;

wherein the collar has an upper cylindrical section and a lower frustoconical section;

wherein, when the collar is pushed downward over the open bottom, the frustoconical section applies a compression force onto the open bottom of the main body member and aligns the blades into one continuous annular blade.

9. The combined function wine bottle foil cutter and cork remover described in claim 8 wherein the main body member further comprises at least one internal shoulder surface located a desired distance upward from each at least one internal blade.

10. The combined function wine bottle foil cutter and cork remover described in claim 8 wherein the main body member comprises six flexible finger elements each separated by a longitudinal slot.

11. The combined function wine bottle foil cutter and cork remover described in claim 8, further comprising a hollow movable sleeve within the main body member into which the shaft is inserted.

12. The combined function wine bottle foil cutter and cork remover described in claim 11 wherein the exterior surface of the shaft has a threaded pattern and the interior passageway found in the handle comprises a threaded pattern complimentary to the threaded shaft.

13. A combined function wine bottle foil cutter and cork remover comprising:

a hollow main body member with an open top and an open bottom;

wherein the main body member comprises six flexible finger elements separated by longitudinal slots extending a desired distance upward from the open bottom;

wherein the interior surface of each finger comprises at least one individual blade located a designated distance from the open bottom;

at least one internal shoulder surface located a desired distance upward from each at least one internal blade;

a spiral corkscrew inserted longitudinally within the main body member;

wherein the corkscrew is rotatably secured with a shaft extending towards, and inserted into, a handle located at the open top of the main body member;

wherein the handle has an interior passageway into which the shaft is inserted; and a collar slidably set around the main body member;

wherein, the collar has a cylindrical upper section and a frustoconical lower section;

wherein, when the collar is slid towards the open bottom, the frustoconical section compresses each of said fingers together to align said individual blades into one continuous annular blade.

14. The combined function wine bottle foil cutter and cork remover described in claim 13, further comprising a hollow movable sleeve within the main body member into which the shaft is inserted.

15. The combined function wine bottle foil cutter and cork remover described in claim 14 wherein the exterior surface of the shaft has a threaded pattern and the interior passageway found in the handle comprises a threaded pattern complimentary to the threaded shaft.

* * * * *